US010660448B2

(12) United States Patent
Choi

(10) Patent No.: US 10,660,448 B2
(45) Date of Patent: May 26, 2020

(54) FOLDING BEDSTEAD

(71) Applicant: Inno-Sports Co. Ltd., Xiamen (CN)

(72) Inventor: Kwan Jun Choi, Xiamen (CN)

(73) Assignee: Inno-Sports Co., LTD., Xiamen (CN)

( * ) Notice: Subject to any disclaimer, the term of this patent is extended or adjusted under 35 U.S.C. 154(b) by 568 days.

(21) Appl. No.: 15/600,581

(22) Filed: May 19, 2017

(65) Prior Publication Data

US 2017/0347805 A1 Dec. 7, 2017

(30) Foreign Application Priority Data

May 20, 2016 (CN) ..... 2016 2 0462390 U

(51) Int. Cl.
*A47C 19/12* (2006.01)
*A47C 19/02* (2006.01)

(52) U.S. Cl.
CPC ..... *A47C 19/12* (2013.01); *A47C 19/024* (2013.01); *A47C 19/025* (2013.01); *A47C 19/128* (2013.01)

(58) Field of Classification Search
CPC ..... A47C 19/12; A47C 19/024; A47C 19/128
See application file for complete search history.

(56) References Cited

U.S. PATENT DOCUMENTS

| | | | |
|---|---|---|---|
| 202,685 | A | 4/1878 | White |
| 324,843 | A | 8/1885 | Horton |
| 337,415 | A | 3/1886 | McKeough |
| 893,364 | A | 7/1908 | Piaser |
| 1,196,253 | A | 8/1916 | Lovvy |
| 4,773,108 | A | 9/1988 | Leever |
| 6,062,589 | A | 5/2000 | Cheng |
| 6,223,628 | B1 | 5/2001 | Barron |
| 6,575,656 | B2 | 6/2003 | Suh |
| 6,938,927 | B1 | 9/2005 | Martin |
| 7,066,676 | B2 | 6/2006 | Tsai |
| 7,849,867 | B2 | 12/2010 | Takayama |
| 7,874,303 | B2 | 1/2011 | Xie |
| 8,806,677 | B1 | 8/2014 | Bartelsmeyer |

(Continued)

FOREIGN PATENT DOCUMENTS

| | | | |
|---|---|---|---|
| CN | 204336376 | U | 5/2015 |
| CN | 204336377 | U | 5/2015 |
| GB | 810195 | A | 3/1959 |

*Primary Examiner* — Robert G Santos
*Assistant Examiner* — Adam C Ortiz
(74) *Attorney, Agent, or Firm* — Morgan, Lewis & Bockius LLP

(57) ABSTRACT

A folding bedstead comprises a first and second unit bedsteads hinged through one or more connecting positions. The unit bedsteads comprise a frame comprising a plurality of corners and an interior. A plurality of bars are disposed in one direction of the frame internally. Each connecting member is disposed in a corner and comprises a body and a first and second lugs. The body is coupled to the corner. The first and second lugs are disposed in the body. A supporting leg, hinged with the first lug, is disposed thereon. A diagonal bracing member is disposed on the second lug wherein one end of the diagonal bracing member is coupled with the second lug, and another end of the diagonal bracing member is coupled with the supporting leg. A third lug is disposed on the body wherein one side of the supporting leg presses against the third lug when unfolded.

11 Claims, 7 Drawing Sheets

(56) References Cited

U.S. PATENT DOCUMENTS

| | | | | |
|---|---|---|---|---|
| 8,856,984 | B1 | 10/2014 | Donham | |
| 8,888,123 | B1 | 11/2014 | Cheng | |
| 9,027,952 | B2 | 5/2015 | Zhu | |
| 9,107,509 | B2 | 8/2015 | Lee | |
| 9,248,072 | B2 | 2/2016 | Wu | |
| 9,254,046 | B1 | 2/2016 | Arenstein | |
| 9,456,698 | B2 | 10/2016 | Oh | |
| 9,895,003 | B2 | 2/2018 | Choi | |
| 9,913,544 | B1 * | 3/2018 | Weinschreider ..... | A47C 19/045 |
| 10,123,629 | B2 | 11/2018 | Choi | |
| 10,125,801 | B2 | 11/2018 | Wilson | |
| 10,285,506 | B2 | 5/2019 | Choi | |
| 10,506,884 | B2 * | 12/2019 | Kramer ..... | A47C 19/025 |
| 2006/0062632 | A1 | 3/2006 | Jang | |
| 2007/0012346 | A1 | 1/2007 | Choi | |
| 2011/0099712 | A1 | 5/2011 | Jin | |
| 2012/0222216 | A1 | 9/2012 | Jin | |
| 2013/0067659 | A1 | 3/2013 | Oh | |
| 2013/0276228 | A1 | 10/2013 | Hsieh | |
| 2015/0320225 | A1 | 11/2015 | Boyd | |
| 2015/0327684 | A1 | 11/2015 | Lee | |
| 2016/0157620 | A1 * | 6/2016 | Oh ..... | A47C 19/024 5/312 |
| 2018/0110339 | A1 | 4/2018 | Moon | |
| 2018/0192778 | A1 | 7/2018 | Choi | |
| 2018/0271296 | A1 | 9/2018 | Harrow | |
| 2018/0332973 | A1 | 11/2018 | Choi | |
| 2019/0029435 | A1 | 1/2019 | Choi | |
| 2019/0045938 | A1 | 2/2019 | Skaggs | |

* cited by examiner

FOLDING BEDSTEAD

CROSS-REFERENCE(S) TO RELATED APPLICATIONS

The present application claims priority to Chinese Invention Application CN 201620462390.9 filed on May 20, 2016, the entire contents of which is incorporated herein for all purposes by this reference.

TECHNICAL FIELD

The present disclosure generally relates to a bedstead, and more particularly, a folding bedstead.

BACKGROUND

In general, as the population continues to grow and living quarters become more compact, articles of daily use must have diversified adjustable functions. Bedsteads have become necessities for many home lives, as bedsteads are expected to be freely folded to reduce storage volume. The service life of a bedstead can be attributed to the build quality and shake resistance.

Conventional bedsteads utilize a sub-optimal configuration to inhibit the influence due to shake. In the conventional methods, locking holes are formed at the bottom portion of each bedstead body and the horizontal bars respectively, and two lugs are formed at both ends of the diagonal bracing bar. The two lugs are directly fixed onto the bedstead body and the horizontal bar using screws. When a folding bedstead with the present structure is folded, screws at one end of the two diagonal bracing bars must be unscrewed, otherwise the folding bedstead cannot be folded until the diagonal bracing bars are separated from the bedstead body or the horizontal bar. Consequently, time and labor are greatly consumed during folding operations.

The information disclosed in this Background section is only for enhancement of understanding of the general background of the invention and should not be taken as an acknowledgement or any form of suggestion that this information forms the prior art already known to a person skilled in the art.

SUMMARY

The folding bedstead detailed in the present disclosure address the shortcomings in the prior art detailed above.

Various aspects of the present disclosure are directed to providing a folding bedstead, which utilizes a more convenient folding and unfolding operation using supporting legs having a simple connecting structure, yielding a reduction in assembling time and manufacturing cost.

In accordance with an aspect of the present disclosure, the above and other objects can be accomplished by the provision of a folding bedstead, comprising a first unit bedstead disposed on a first side and a second unit bedstead disposed on a second side of the folding bedstead. Moreover, the first unit bedstead is hinged to the second unit bedstead through one or more connecting positions thereof. Each of the first unit bedstead and the second unit bedstead comprises a frame comprising a plurality of corners and an interior. They further comprise a plurality of first bars disposed in a common direction in the interior of the frame. A plurality of connecting members, formed in such a way that each respective connecting member in the plurality of connecting members, is disposed in a corresponding corner in the plurality of corners of the frame. Each respective connecting member in the plurality of connecting members comprises a body, a first lug, and a second lug.

The body of a respective connecting member in the plurality of connecting members is coupled to a corresponding corner of a corresponding first unit bedstead or second unit bedstead. Further, the first lug and the second lug of the respective connecting member in the plurality of connecting members are disposed in the body of the respective connecting member.

A supporting leg hinged with the first lug of a corresponding connecting member in the plurality of connecting members is disposed on the first lug. A diagonal bracing member is disposed on the second lug of a corresponding connecting member in the plurality of connecting members so that a first end of the diagonal bracing member is coupled with the second lug. A second end of the diagonal bracing member is coupled with the supporting leg. A third lug is disposed on the body of a respective connecting member in the plurality of connecting members in such a way that a first side of the supporting leg presses against the third lug when the supporting leg is unfolded.

Preferably, a clamping block is coupled with a first end of the supporting leg, and a sliding groove is formed in the supporting leg so that the clamping block is slideable in the sliding groove. A stop block is disposed at a first end portion of the clamping block, and a first opening and a second opening are formed at a first end and a second end of the sliding groove, respectively, and configured so that a size of the first opening is different than a size of the second opening, and a size of the stop block is between the size of the first opening and the size of the second opening.

In some embodiments, the folding bedstead is formed in such a way that the first lug, the second lug, and the third lug of a respective connecting member in the plurality of connecting members are disposed stepwise on the same side of the body of the respective connecting member. The body of the respective connecting member is connected with an internal side of the frame.

In some embodiments, the folding bedstead comprises a connecting bar disposed in the frame in parallel with the plurality of first bars, so that a first end of the connecting bar is connected with a first internal side of the frame, a second end of the connecting bar is connected with a second internal side of the frame, and the body of a corresponding connecting member in the plurality of connecting members is coupled with the first and second internal side of the frame and a first side of the connecting bar.

In a further embodiment, the folding bedstead comprises a connecting bar disposed in the frame in parallel with the plurality of first bars, so that the folding bedstead further comprises a plurality of second bars, formed in such a way that each respective second bar in the plurality of second bars is attached to a corresponding bottom portion of a first end of a corresponding first bar in the plurality of first bars, and a second end of the corresponding first bar, and the body of a connecting member in the plurality of connecting members is coupled with a first side of a corresponding second bar in the plurality of second bars and a first side of the corresponding connecting bar.

The folding bedstead according to an exemplary embodiment of the present disclosure is provided to cure the disadvantages of the prior art while having the advantage of a simple and convenient connecting structure and folding operations as well as a reduction in assembly time and manufacturing costs.

The methods and apparatuses of the present disclosure have other features and advantages which will be apparent from or are set forth in more detail in the accompanying drawings, which are incorporated herein, and the following Detailed Description, which together serve to explain certain principles of the present invention.

Figure 1:
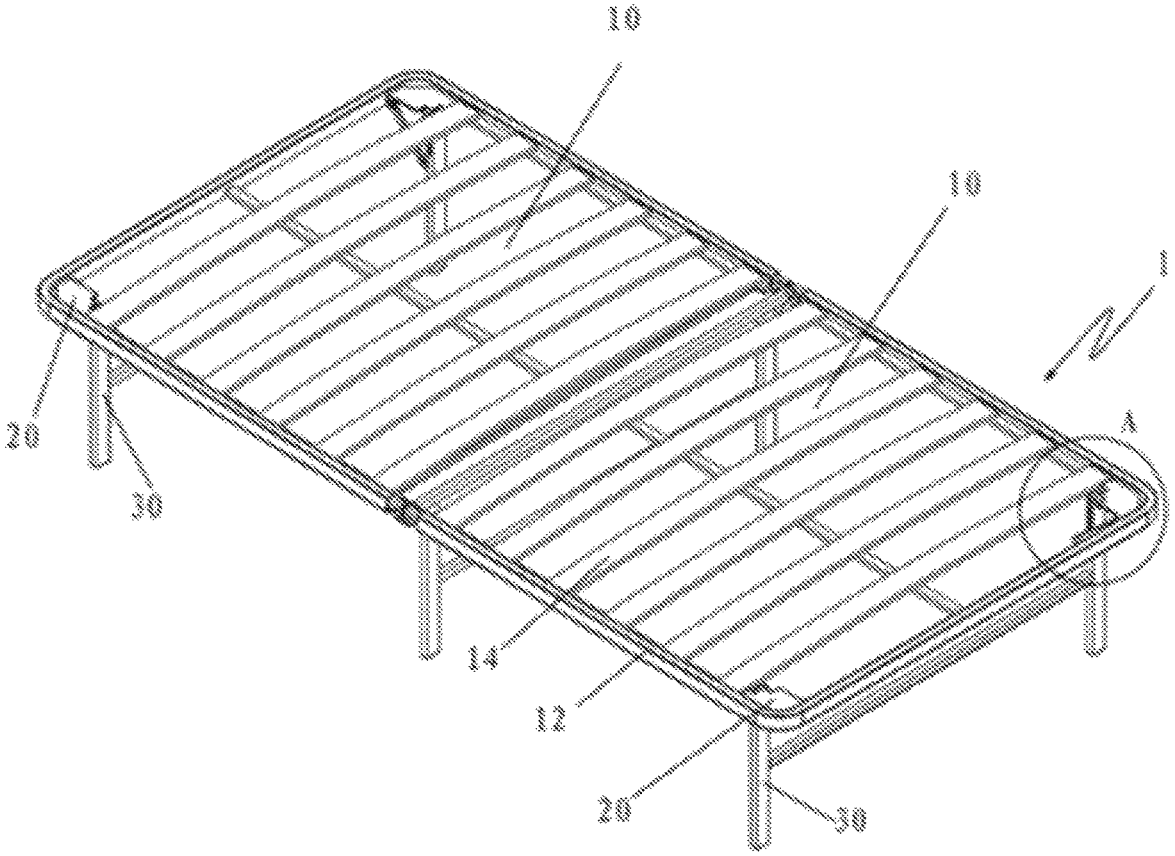
FIG. 1 is a schematic view of a folding bedstead according to an exemplary embodiment of the present disclosure.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawing and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the present invention as defined by the appended claims.

It will also be understood that, although the terms first, second, etc. may be used herein to describe various elements, these elements should not be limited by these terms. These terms are only used to distinguish one element from another. For example, a first subject could be termed a second subject, and, similarly, a second subject could be termed a first subject, without departing from the scope of the present disclosure. The first subject and the second subject are both subjects, but they are not the same subject. Furthermore, the terms "subject" and "user" are used interchangeably herein.

The terminology used in the present disclosure is for the purpose of describing particular embodiments only and is not intended to be limiting of the invention. As used in the description of the invention and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and or "comprising," when used in this specification, specify the presence of stated features, integers, steps, operations, elements, and or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

Figure 2:
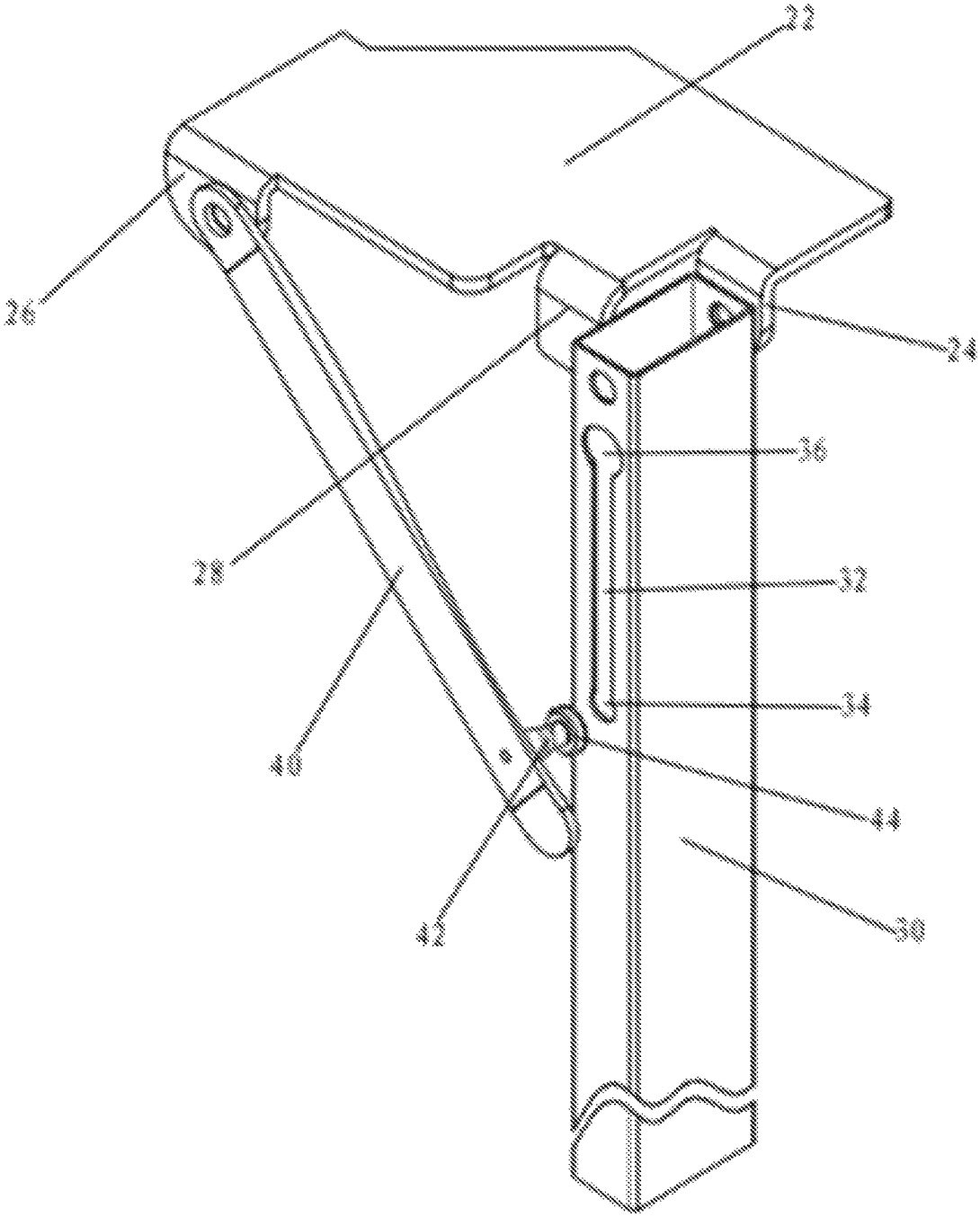
FIG. 2 is a schematic view of a connecting structure of a supporting leg according to an exemplary embodiment of the present disclosure.
Figure 3:
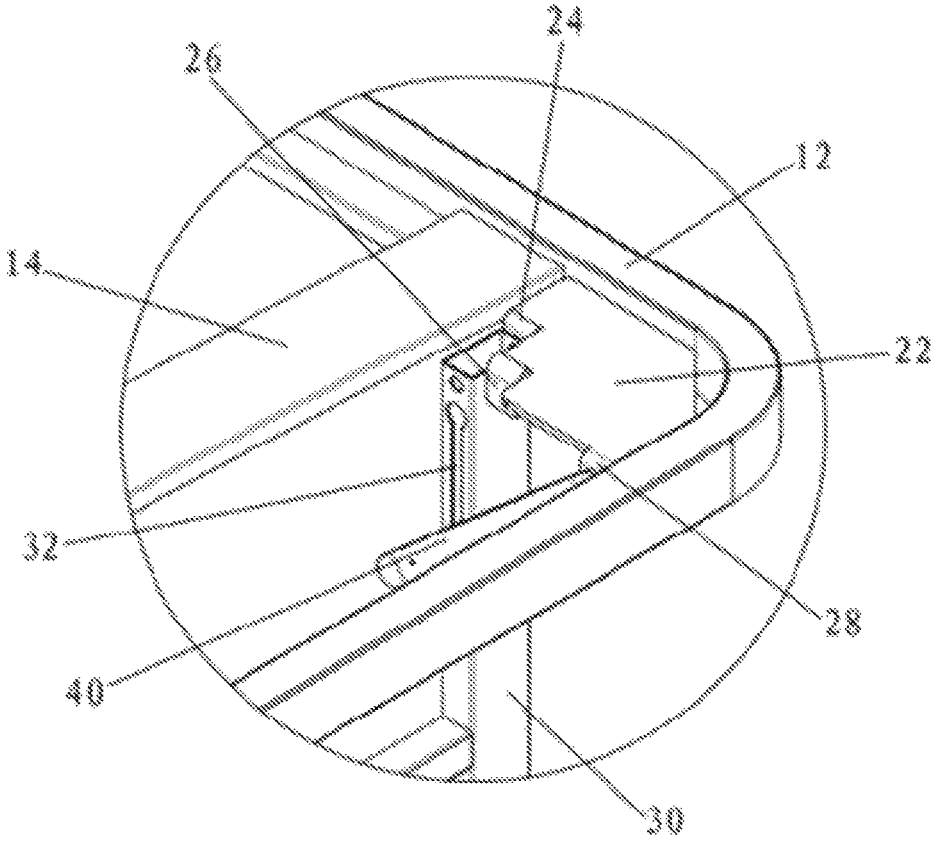
FIG. 3 is an enlarged schematic view of the region 'A' in FIG. 1.

An aspect of the present disclosure is directed to provide a folding bedstead 1. Referring to FIG. 1 to FIG. 3, the folding bedstead 1 comprises a first unit bedstead 10 disposed on a first side and a second unit bedstead 10 disposed on a second side of the folding bedstead 1. Moreover, the first unit bedstead 10 is hinged to the second unit bedstead 10 through one or more connecting positions thereof. Each of the first unit bedstead 10 and the second unit bedstead 10 comprises a frame 12. Each frame 12 comprises a plurality of corners and an interior. Each frame 12 further comprises a plurality of first bars 14 disposed in a common direction in the interior of the frame 12. Each frame 12 further comprises a plurality of connecting members 20, formed in such a way that each respective connecting member 20 in the plurality of connecting members 20 is disposed in a corresponding corner in the plurality of corners of the frame 12.

Each respective connecting member 20 in the plurality of connecting members 20 comprises a body 22, a first lug 24, and a second lug 26. The body 22 of a respective connecting member 20 in the plurality of connecting members 20 is coupled to a corresponding corner of a corresponding first unit bedstead 10 or second unit bedstead 10. The first lug 24 and the second lug 26 of respective connecting member 20 in the plurality of connecting members 20 are disposed in the body 22 of the respective connecting member 20.

A supporting leg 30 is hinged with the first lug 24 of a corresponding connecting member 20 in the plurality of connecting members 20 and disposed on the first lug 24.

A diagonal bracing member 40 is disposed on the second lug 26 of a corresponding connecting member 20 in the plurality of connecting members 20, so that a first end of the diagonal bracing member 40 is coupled with the second lug 26, and a second end of the diagonal bracing member 40 is coupled with the supporting leg 30. A third lug 28 is disposed on the body 22 of a respective connecting member 20 in the plurality of connecting members 20 in such a way that a first side of the supporting leg 30 presses against the third lug 28 when the supporting leg 30 is unfolded. The third lug 28 limits the position of the supporting leg 30 allowing for a convenient folding operation.

Referring to FIG. 2, a clamping block 42 is coupled with a first end of the supporting leg 30, and a sliding groove 32 is formed in the supporting leg 30 so that the clamping block 42 is slideable in the sliding groove 32. A stop block 44 is disposed at a first end portion of the clamping block 42. Further, a first opening 34 and a second opening 36 are formed at respective first and second ends of the sliding groove 32. A size of the first opening 34 is different than a size of the second opening 36. For instance, as illustrated in FIG. 2, opening 36 is larger than opening 34. A size of the stop block 44 is between the size of the first opening 32 and the size of the second opening 34. The stop block 44 penetrates the opening with a larger diameter (e.g., I in FIG. 2, opening 36) thereby allowing the stop block 44 to slide in the sliding groove 32. The opening with a smaller diameter is configured to clamp the stop block 44 in the smaller opening in such a way that the stop block 44 will not be restored to an initial position naturally. In the present embodiment, the diagonal bracing member 40 is formed from an elastic material having an elasticity.

In some embodiments, the folding bedstead 10 is formed in such a way that the first lug 24, the second lug 26, and the third lug 28 of a respective connecting member 20 in the plurality of connecting members 20 are disposed stepwise on the same side of the body 22 of the respective connecting member 20. As shown in FIG. 1 to FIG. 3, the body 22 of the respective connecting member 20 is connected with an internal side of the frame 12.

Figure 4:
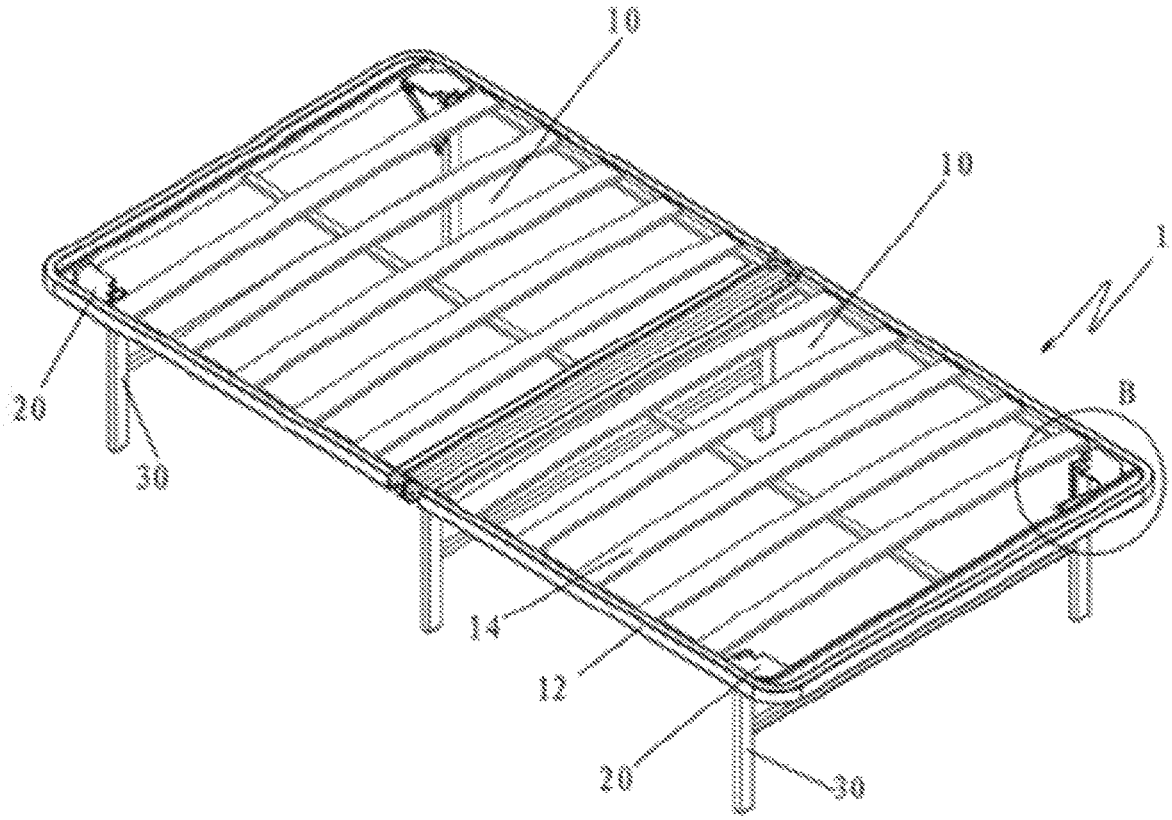
FIG. 4 is a schematic view of a folding bedstead according to another exemplary embodiment of the present disclosure.
Figure 5:
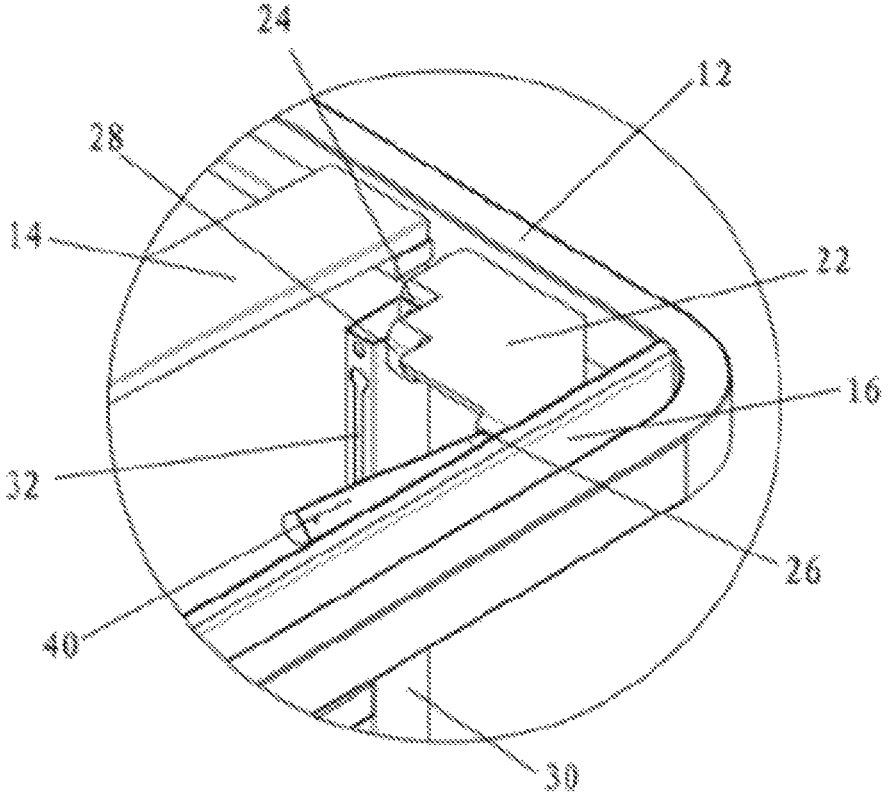
FIG. 5 is an enlarged schematic view of the region 'B' in FIG. 4.

Referring to FIG. 4 and FIG. 5, in another exemplary embodiment of the present disclosure, the folding bedstead 1 comprises a connecting bar 16 disposed in the frame 12 in parallel with the plurality of first bars 14 in such a way that a first end of the connecting bar 16 is connected with a first internal side of the frame 12, and a second end of the connecting bar 16 is connected with a second internal side of the frame 12. The body 22 of a corresponding connecting member 20 in the plurality of connecting members 20 is coupled with the a first and second internal side of the frame 12 and a first side of the connecting bar 16.

Figure 6:
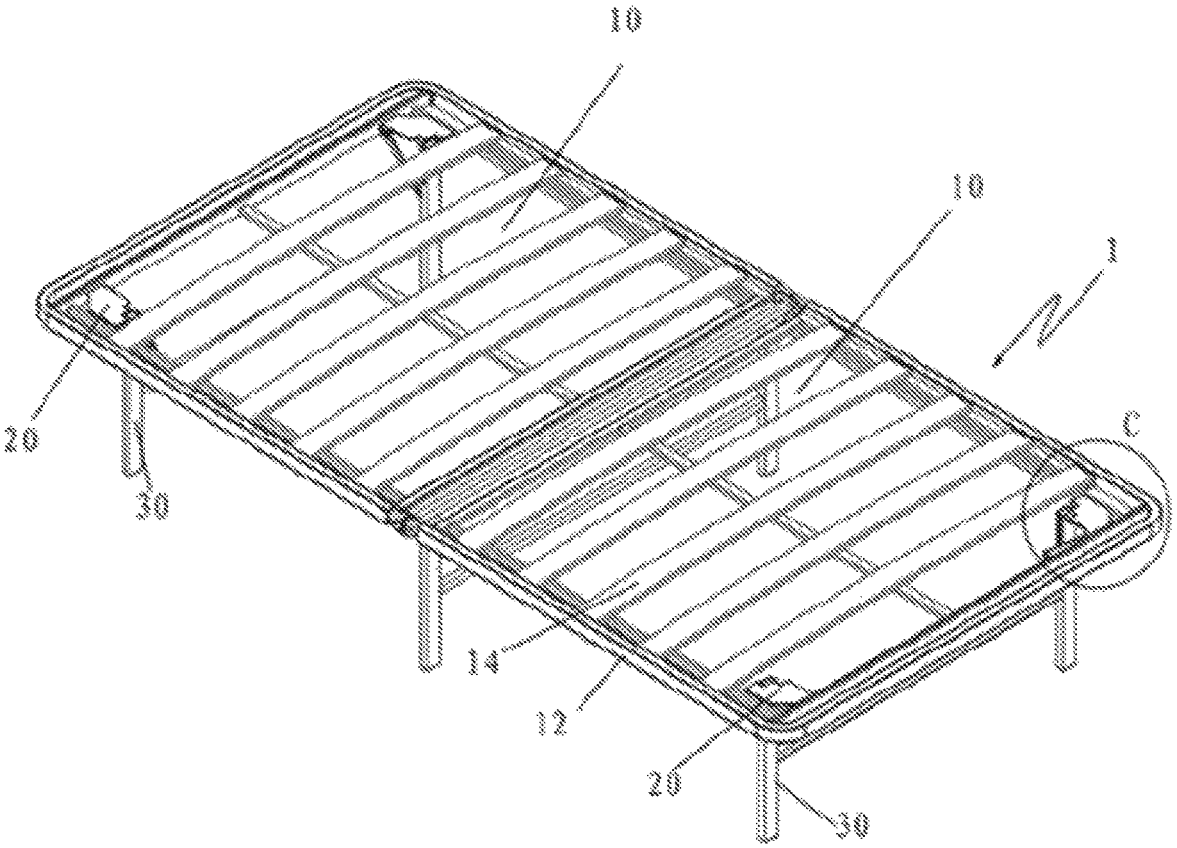
FIG. 6 is a schematic view of a folding bedstead according to yet another exemplary embodiment of the present disclosure.
Figure 7:
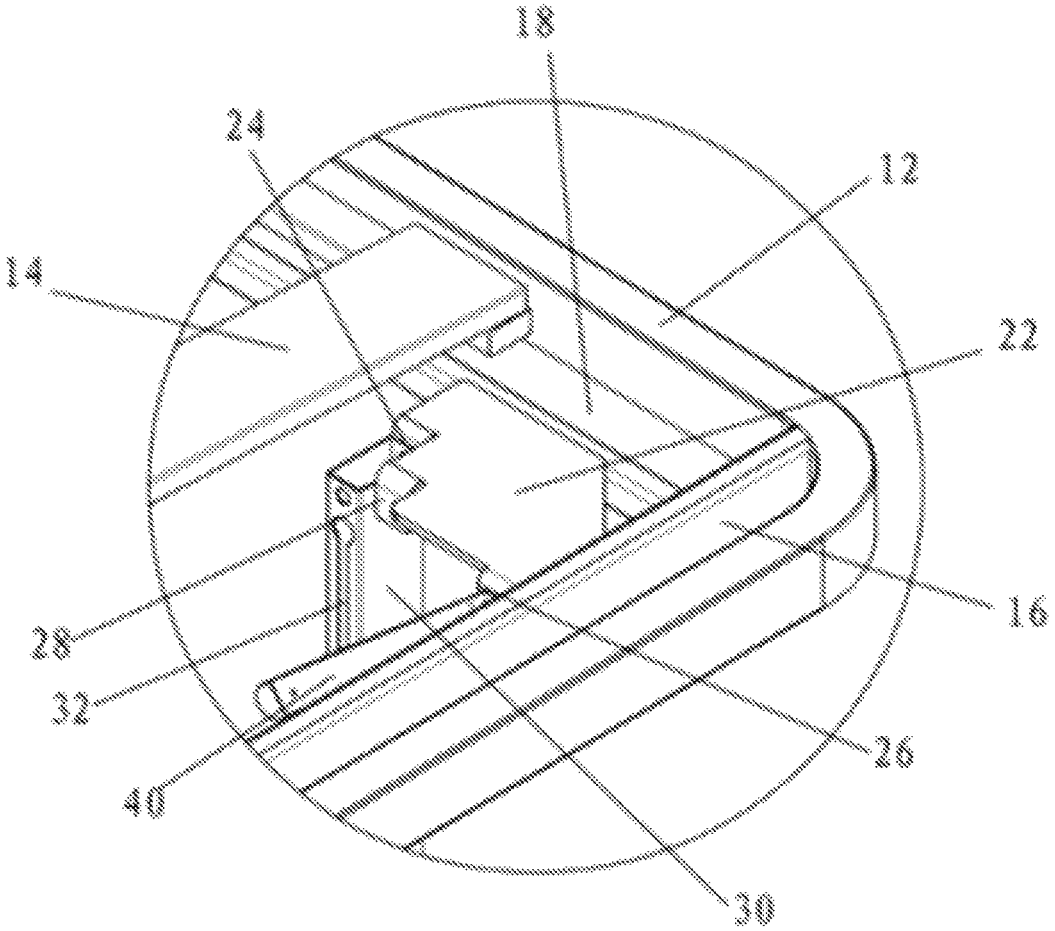
FIG. 7 is an enlarged schematic view of the region 'C' in FIG. 6.

Referring to FIG. 6 and FIG. 7, in a further exemplary embodiment of the present disclosure, the folding bedstead 1 comprises a connecting bar 16 disposed in the frame 12 in parallel with the plurality of first bars 14. Moreover, the folding bedstead 1 further comprises a plurality of second bars 18. Each respective second bar 18 in the plurality of second bars 18 is attached to a corresponding bottom portion of a first end of a corresponding first bar 14 in the plurality of first bars 14 and a second end of the corresponding first bar 14. The body 22 of a connecting member 20 in the plurality of connecting members 20 is coupled with a first side of a corresponding second bar 18 in the plurality of second bars 18 and a first side of the corresponding connecting bar 16.

Accordingly, a folding bedstead according to an exemplary embodiment of the present disclosure achieves the advantages of a simple and convenient connecting structure and folding operations as well as a reduction in assembly time and manufacturing costs.

For convenience in explanation and accurate definition in the appended claims, the terms "upper", "lower", "up", "down", "upwards", "downwards", "inner", "outer", "inside", "outside", "inwardly", "outwardly", "interior", "exterior", "front", "rear", "back", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various alternatives and modifications thereof. It is intended that the scope of the invention be defined by the Claims appended hereto and their equivalents.

What is claimed is:

1. A folding bedstead, comprising a first unit bedstead disposed on a first side and a second unit bedstead disposed on a second side of the folding bedstead, wherein the first unit bedstead is pivotally connected with the second unit bedstead, and wherein each of the first unit bedstead and the second unit bedstead comprises: a frame comprising a plurality of corners and an interior; a plurality of bars disposed in the interior of the frame and coupled with the frame; a plurality of connecting members, each disposed in a corresponding corner in the plurality of corners of the frame and comprising: a body coupled with (i) the frame, (ii) the frame and a bar in the plurality of bars, or (iii) one or more bars in the plurality of bars; a first lug at a first edge of the body and bended with respect to the body; and a second lug at a second edge of the body and bended with respect to the body; a plurality of supporting legs, each pivotally coupled with the first lug of a corresponding connecting member in the plurality of connecting members; and a plurality of diagonal bracing members, each having a first end pivotally coupled with the second lug of a corresponding connecting member in the plurality of connecting members, and a second end movably coupled with a corresponding supporting leg in the plurality of supporting legs; wherein each respective connecting member in the plurality of connecting members further comprises: a third lug at a third edge of the body and bent with respect to the body, wherein a first side of the corresponding supporting leg presses against the third lug when the supporting leg is unfolded.

2. The folding bedstead according to claim 1, wherein each respective diagonal bracing member in the plurality of diagonal bracing members comprises:

a clamping block at the second end thereof to movably couple with a corresponding supporting leg in the plurality of supporting legs, wherein a sliding groove is formed in the corresponding supporting leg, and wherein the clamping block is slideable in the sliding groove.

3. The folding bedstead according to claim 2, wherein the clamping block comprises:

a stop block disposed at a first end portion of the clamping block, wherein a first opening and a second opening are formed at a first end and a second end of the sliding groove, respectively, a size of the first opening is different than a size of the second opening, and a size of the stop block is between the size of the first opening and the size of the second opening.

4. The folding bedstead according to claim 1, wherein the first lug, and the third lug, and the second lug of a respective connecting member in the plurality of connecting members are disposed stepwise on the same side of the body of the respective connecting member.

5. The folding bedstead according to claim 1, wherein the body of the respective connecting member is connected with an internal side of the frame.

6. The folding bedstead according to claim 1, wherein the plurality of bars comprises:

a plurality of first bars disposed in a first common direction in the interior of the frame; and a connecting bar disposed in the interior of the frame in parallel with the plurality of first bars, wherein a first end of the connecting bar is connected with a first internal side of the frame, a second end of the connecting bar is connected with a second internal side of the frame, and the body of a respective connecting member in the plurality of connecting members is coupled with a corresponding internal side in the first and second internal sides of the frame and with a first side of the connecting bar.

7. The folding bedstead according to claim 1, wherein the plurality of bars further comprises:

a plurality of first bars disposed in a first common direction in the interior of the frame;

a connecting bar disposed in the interior of the frame in parallel with the plurality of first bars, the connecting bar having a first end connected with a first internal side of the frame and a second end of the connecting bar is connected with a second internal side of the frame; and a second bar disposed at or adjacent each of the first and second internal sides of the frame in a second direction different than the first common direction, wherein the second bar is disposed below the plurality of first bars when the folding bedstead is in an unfolded state, wherein the body of a respective connecting member in the plurality of connecting members is coupled with a first side of the second bar disposed at a corresponding internal side in the first and second internal sides of the frame and with a first side of the connecting bar.

8. The folding bedstead according to claim 1, wherein each of the plurality of diagonal bracing members is formed of an elastic material.

9. The folding bedstead according to claim 1, wherein the body of the connecting member is connected with an internal side of the frame.

10. The folding bedstead according to claim 1, wherein the plurality of bars comprises:

a connecting bar disposed in the interior of the frame, and having a first end connected with a first internal side of the frame and a second end connected with a second internal side of the frame, wherein the body of the connecting member is coupled with a corresponding internal side in the first and second internal sides of the frame and with a first side of the connecting bar.

11. A folding bedstead, comprising a first unit bedstead disposed on a first side and a second unit bedstead disposed on a second side of the folding bedstead, wherein the first unit bedstead is pivotally connected with the second unit bedstead, and wherein each of the first unit bedstead and the second unit bedstead comprises: a frame comprising a plurality of corners and an interior; a plurality of bars disposed in the interior of the frame and coupled with the frame; a plurality of connecting members, each disposed in a corresponding corner in the plurality of corners of the frame and comprising: a body coupled with (i) the frame, (ii) the frame and a bar in the plurality of bars, or (iii) one or more bars in the plurality of bars; a first lug at a first edge of the body and bended with respect to the body; and a second lug at a second edge of the body and bended with respect to the body; a plurality of supporting legs, each pivotally coupled with the first lug of a corresponding connecting member in the plurality of connecting members; and a plurality of diagonal bracing members, each having a first end pivotally coupled with the second lug of a corresponding connecting member in the plurality of connecting members, and a second end movably coupled with a corresponding supporting leg in the plurality of supporting legs wherein the plurality of bars further comprises: a plurality of first bars disposed in a first common direction in the interior of the frame; a connecting bar disposed in the interior of the frame in parallel with the plurality of first bars, the connecting bar having a first end connected with a first internal side of the frame and a second end of the connecting bar is connected with a second internal side of the frame; and a second bar disposed at or adjacent each of the first and second internal sides of the frame in a second direction different than the first common direction, wherein the second bar is disposed below the plurality of first bars when the folding bedstead is in an unfolded state, wherein the body of a respective connecting member in the plurality of connecting members is coupled with a first side of the second bar disposed at a corresponding internal side in the first and second internal sides of the frame and with a first side of the connecting bar.

* * * * *